United States Patent [19]

Wilson

[11] 4,136,545

[45] Jan. 30, 1979

[54] ROLLING MILL STAND

[75] Inventor: Alexander I. Wilson, Sheffield, England

[73] Assignee: Hille Engineering Company Limited, Yorkshire, England

[21] Appl. No.: 810,734

[22] Filed: Jun. 28, 1977

[30] Foreign Application Priority Data

Jun. 29, 1976 [GB] United Kingdom ..... 27020/76

[51] Int. Cl.[2] ..... B21B 31/14

[52] U.S. Cl. ..... 72/238

[58] Field of Search ..... 72/237–239, 72/226, 250

[56] References Cited

U.S. PATENT DOCUMENTS

| | | | |
|---|---|---|---|
| 494,904 | 4/1893 | Story | 72/226 |
| 3,292,406 | 12/1966 | O'Brien | 72/238 |
| 3,336,781 | 8/1967 | Wilson et al. | 72/235 |
| 3,348,403 | 10/1967 | Bartley | 72/237 |
| 3,459,023 | 8/1969 | Adair | 72/250 X |
| 3,491,570 | 1/1970 | Beard | 72/239 |
| 3,566,498 | 3/1971 | Kato et al. | 72/239 X |

*Primary Examiner*—Milton S. Mehr
*Attorney, Agent, or Firm*—Bernard & Brown

[57] ABSTRACT

A rolling mill stand, particularly for a rod or bar mill, has, at each side of the pass line, a rotary roll housing which includes a number of fitments each for detachably carrying a roll assembly. By rotating the roll housings, one of the roll assemblies of each roll housing can be brought into a rolling position, in which it is coupled to drive means. In order to change the rolls at the rolling positions, each of the roll housings is rotated to bring a fresh roll assembly into position. The stand has a roll change rig enabling one or more of the roll assemblies of each roll housing to be quickly run out of the stand and replaced by substitute roll assemblies.

8 Claims, 9 Drawing Figures

ROLLING MILL STAND

Figure 1:
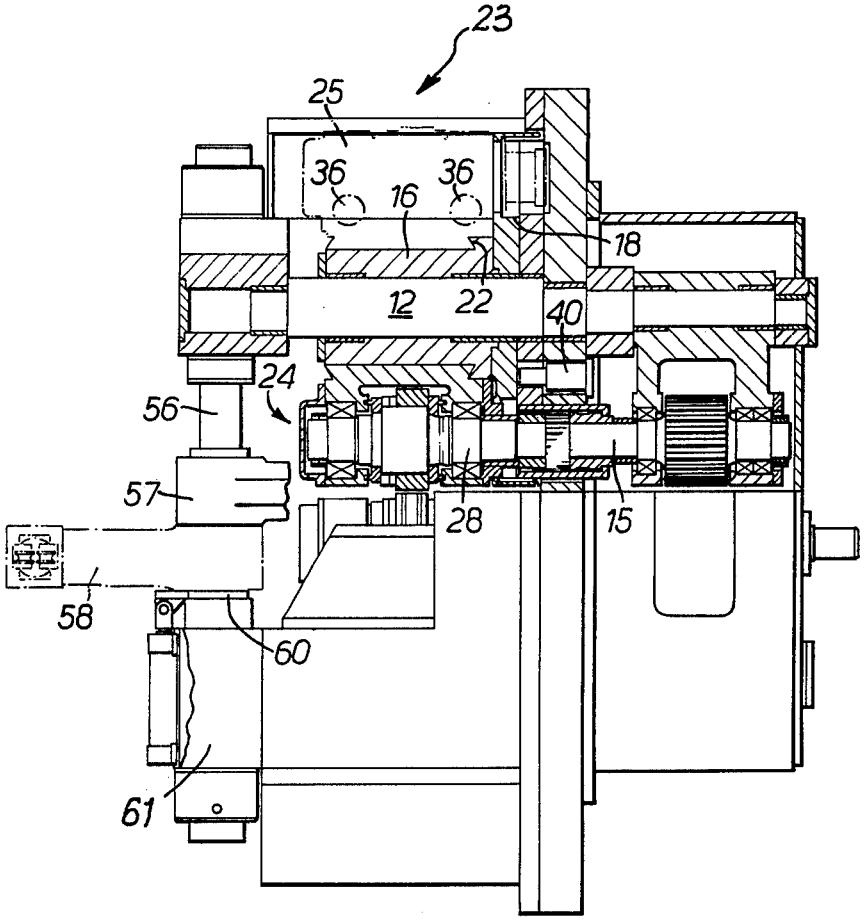

This invention relates to a rolling mill stand, for rolling metal in elongate form, and is particularly, but not exclusively, concerned with a rod mill stand for use in the continuous rolling of rod.

The invention is applicable to a rod mill stand as described in the provisional specification of patent application No. 47037/75 and provides means for enabling the work rolls to be replaced easily and speedily. The present invention is however applicable to other forms of rolling mill stand.

Many expedients have been proposed for facilitating roll change in rolling mills, and particularly in strip mills. All those expedients have entailed the removal of a worn roll from the stand before a new, substitute, roll can be introduced. The labour of physically removing the worn roll from the stand and introducing the substitute roll is time-consuming and involves appreciable down-time of the mill.

According to the present invention, a rolling mill stand comprises a stand housing, a pair of roll housings carried by the stand housing and located on opposite sides of the stand pass line, each mounting having at least two spaced fitments each for supporting a roll assembly and being movable to bring a roll assembly supported in any fitment into an operative rolling position at the pass line, drive means, and coupling means for coupling the drive means with roll assemblies at their operative rolling positions. With such an arrangement, two or more roll assemblies can be carried in a mounting at any one time, one roll being in the operative rolling position and another being in an inoperative, or waiting, position. For roll change, the substitute roll assembly may be brought immediately into the operative position by movement of the mounting, without the need first to remove the worn roll from the mounting and from the stand. The time consumed in a roll change is accordingly much reduced. The worn roll assembly may be left in the stand until a convenient time for its removal.

Each mounting is preferably rotatable and may have fitments for four roll assemblies; in that case, removal of roll assemblies from the stand and substitution of new roll assemblies need take place only when all four assemblies of each housing have been used.

Particularly when the stand is a rod mill stand each roll assembly may comprise a work roll, bearings for the work rolls, and a carrier which supports the bearings and which is detachably securable to any fitment.

Preferably, each mounting is additionally movable parallel to the operative roll axis to enable a roll assembly in operative position to be engaged and disengaged from a roll drive. Thus, each mounting may be rotationally carried on a shaft disposed parallel to the operational roll axis, so that, by rotation of the mounting on the shaft, any roll assembly carried by the mounting may be brought into the operative position. In that case, the mounting may be axially movable on its shaft in order to engage and disengage the operative roll assembly with the roll drive. The drive of the mill may include, for each mounting, a coupling sleeve, with which a roll in operative position may be engaged with a drive shaft.

Figure 1A:
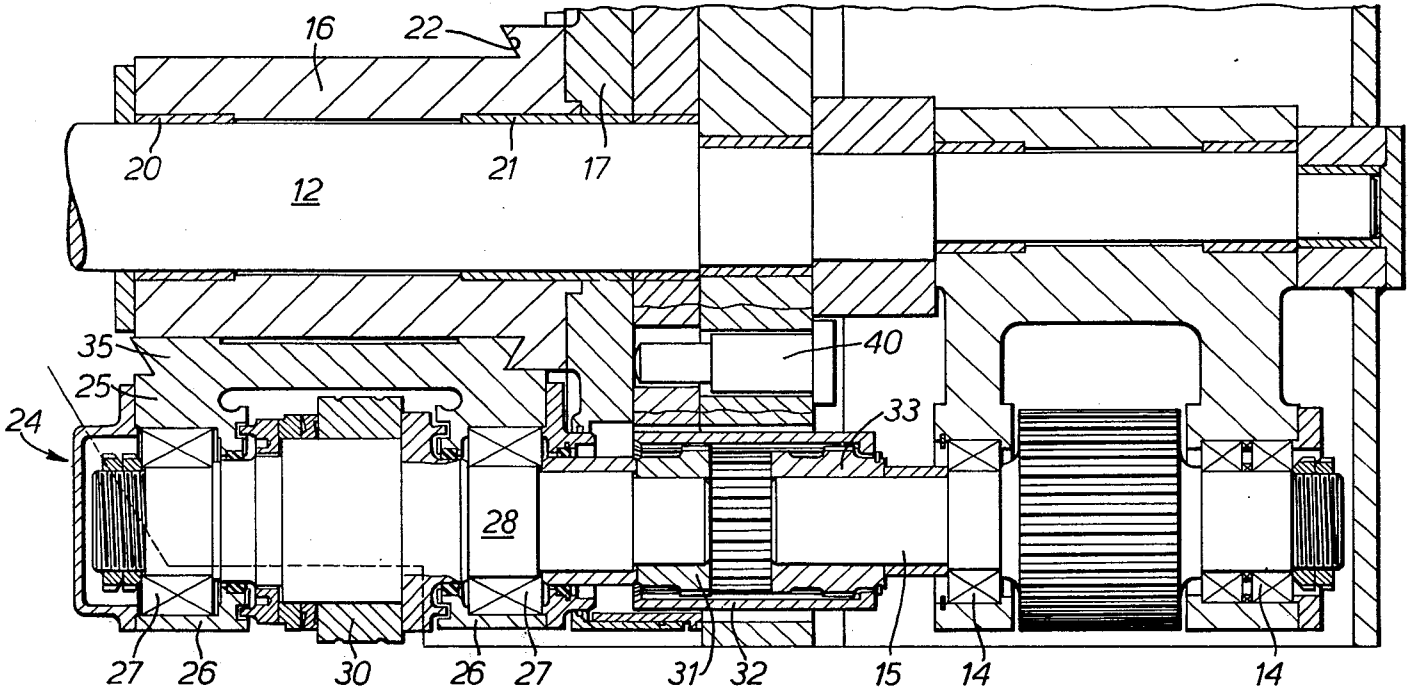
Figure 2:
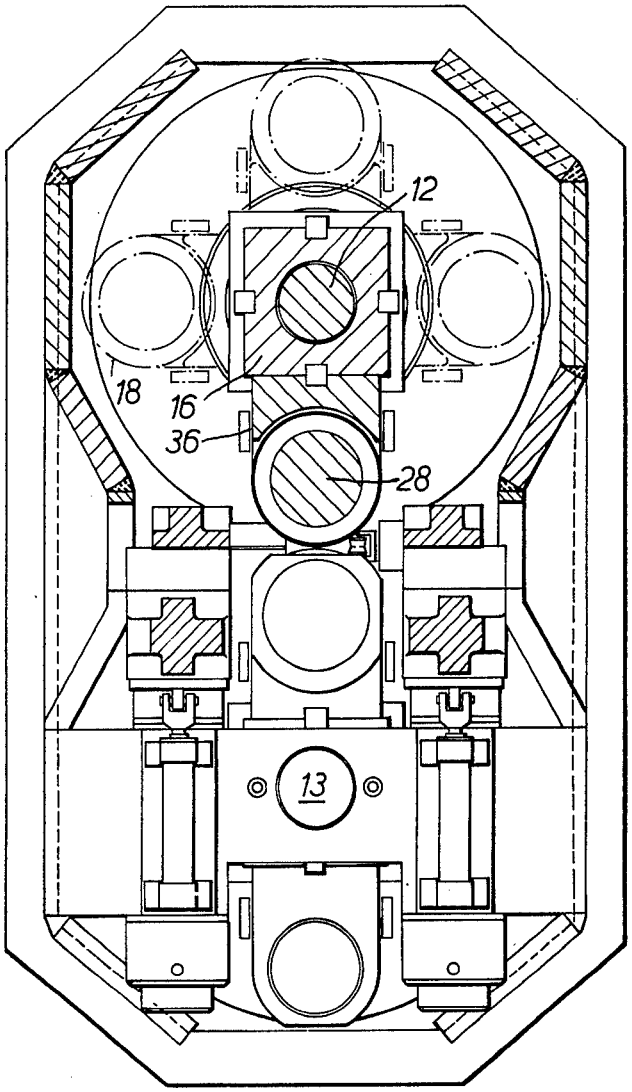
Figure 3:
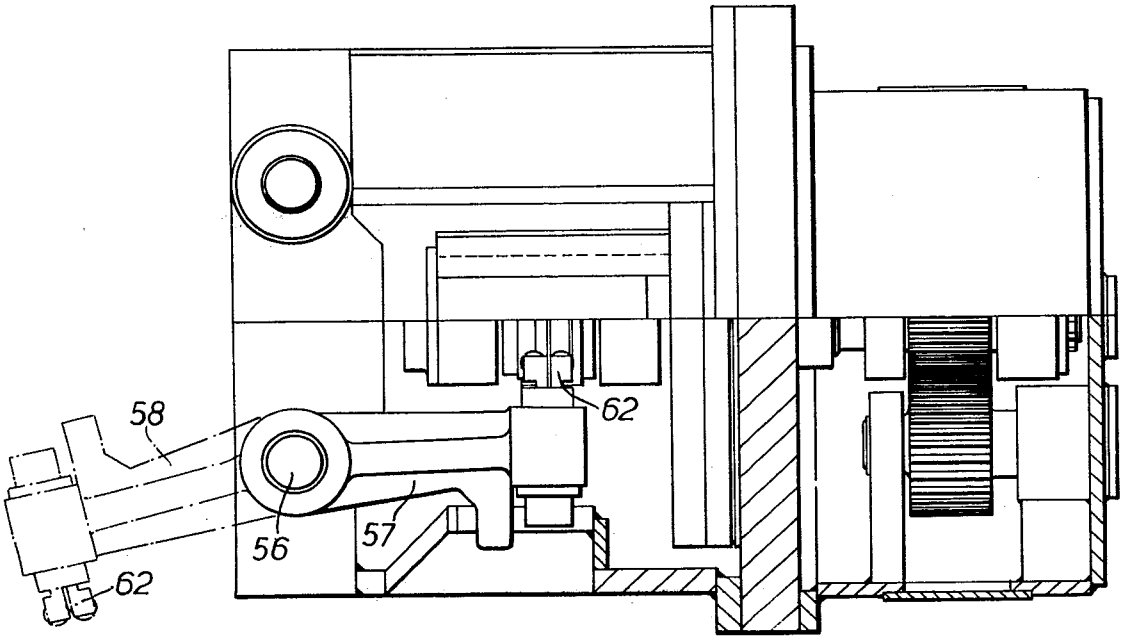
Figure 4:
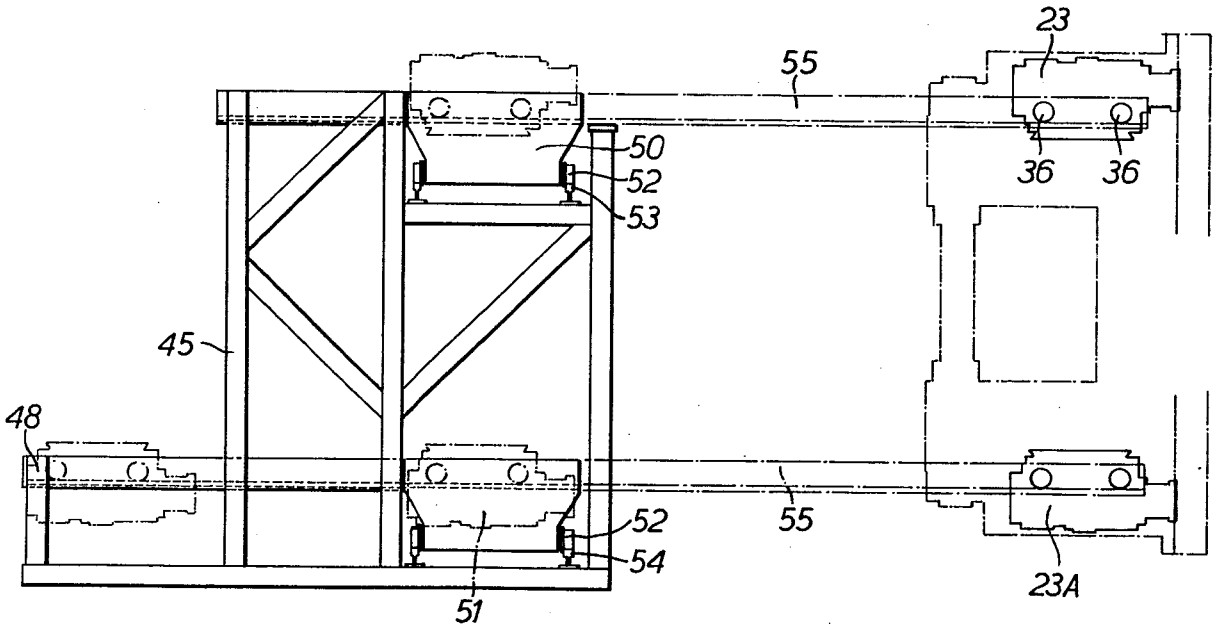
Figure 5:
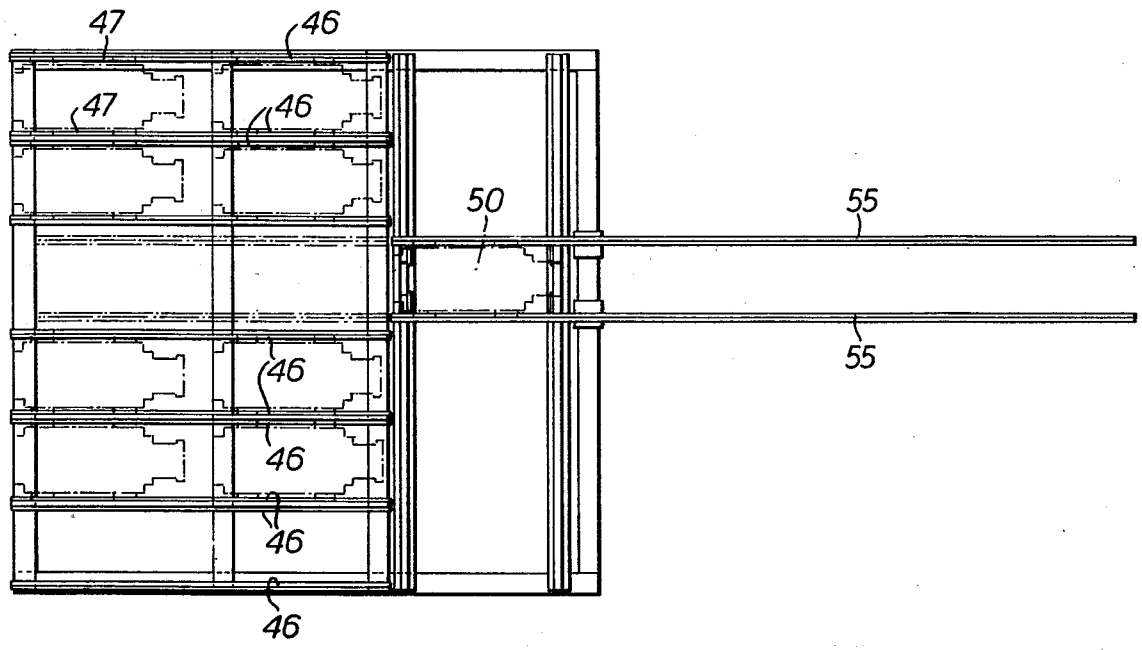
Figure 6:
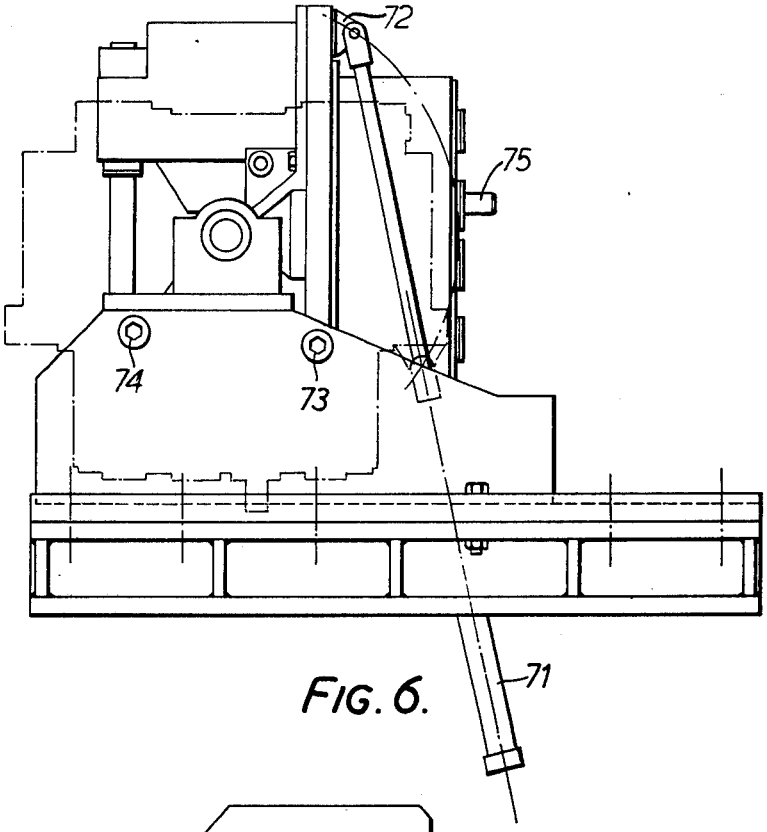
Figure 7:
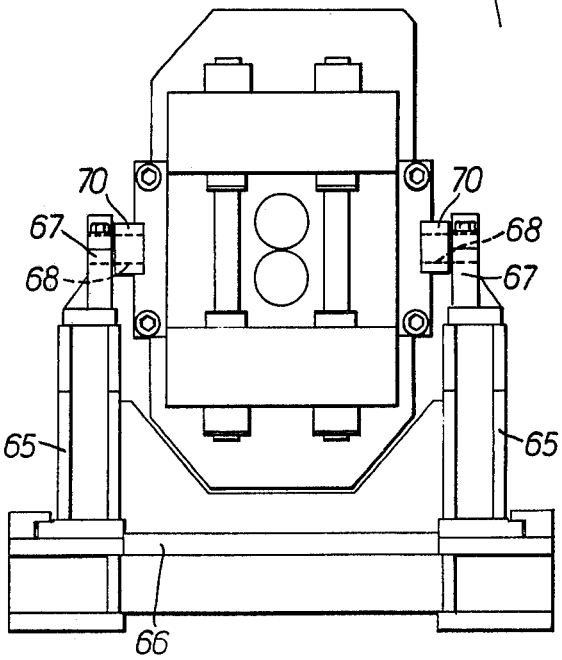
Figure 8:
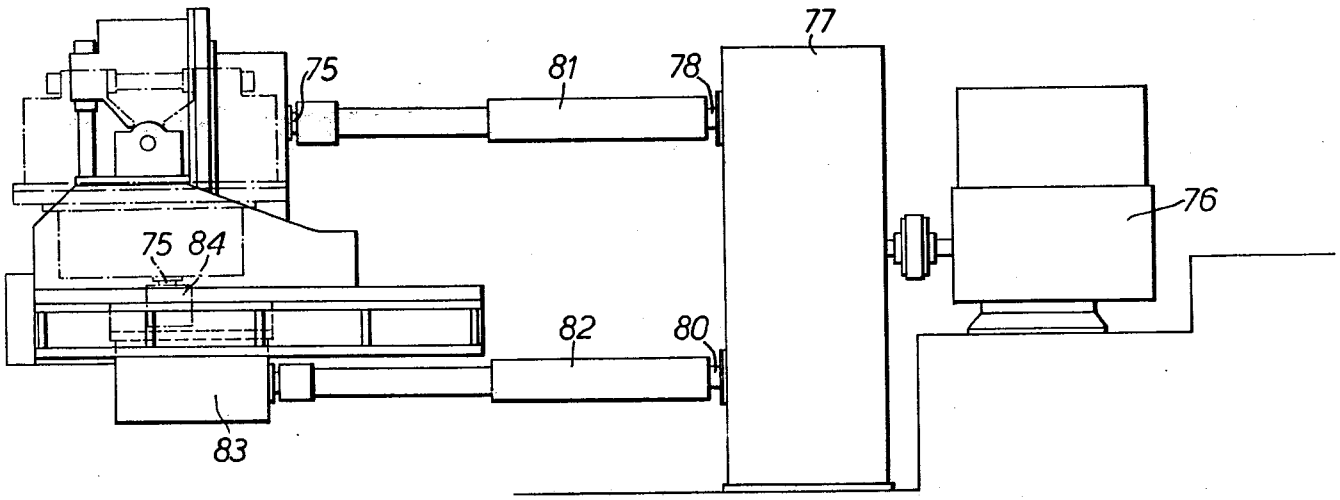

The invention will be more readily understood by way of example from the following description of a rod mill stand, reference being made to the accompanying drawings, in which:

FIGS. 1, 2 and 3 are respectively a half-sectional front elevation, a half-sectional end view and a half-sectional plan view of the rolling mill stand, FIG. 1A is a view of a roll shaft of FIG. 1, but on enlarged scale, FIGS. 4 and 5 are respectively a plan view and a side view of an arrangement for transporting roll cartridges into and out of the stand, FIGS. 6 and 7 are respectively a side view and an end view of a mounting for the stand, and FIG. 8 illustrates the drive to the stand.

Apart from the roll change mechanism, the roll stand shown in the accompanying drawings is generally similar to that described in the provisional specification of application No. 47037/75, to which reference should be made for details of the roll drive. The roll mounting arrangements on the two sides of the passline are similar to one another, and therefore only the mounting above the passline will be described in detail.

Journalled in the stand housing are two eccentric shafts 12 and 13, each of which carries one of the rolls, and the bearings 14 of the drive shaft 15 of that roll. Rotation of the shaft 12, or 13 results in adjustment of the roll gap, by virtue of the eccentric mounting of the shaft, and as explained in the earilier application.

Each of the shafts 12, 13 supports a rotational mounting which, in the example shown, can carry up to four work roll cartridges. That mounting comprises a square-section block 16 having a central bore through which the shaft 12 passes. The block 16 is secured at one end to a ring 17, which also surrounds the shaft 12 and which has four circular openings 18 at 90° intervals. Wear sleeves 20, 21 are interposed between the block 16 and ring 18, on the one hand, and the shaft 12, to enable the block 16 to slide axially on the shaft. The four faces of the block 16 are formed with rebates 22 for the securement of the roll cartridges.

One of the roll cartridges is shown in FIG. 1 in outline at 23, while a second is shown in cross section at 24. As there shown, each cartridge consists of a bearing carrier 25 which, with associated shells 26, supports spaced bearings 27 for a roll shaft 28. As shown in FIG. 1, the roll barrel is formed as a sleeve 30 secured on the roll shaft, but alternatively the roll barrel may be formed integrally with the roll shaft. The right-hand end of the roll shaft 28 carries a sleeve gear 31, which engages with the internal splines of a rotary sleeve 32, the splines which are also engaged by a gear sleeve 33 on the end of the drive shaft 15.

The bearing carrier 25 is formed with a dove-tail 35 adapted to engage at one end with the rebate 22 of block 16, and at the other end with a correspondingly shaped keeper plate secured to block 16. Each roll cartridge 23, 25 carries two pairs of wheels 36, the function of which will be explained later.

When the roll mounting is locked in the position shown in FIG. 1, with roll cartridge 24 in operative position with its roll shaft 28 aligned with and engaging the splined sleeve 32, the mill can be operated, the work rolls 30 being driven by the drive shafts 15. The axial position of the roll 30 can be adjusted, as to change the rolling groove, by adjusting the roll mounting 16, 17 axially on shaft 12, the splined sleeve 32 enabling the axial position of shaft 28 to be adjusted without affecting the drive.

It is desired to change a roll, hydraulic jacks, one of which is shown at 40 is operated to urge the roll mounting 16, 17 axially to the left as viewed in FIG. 1, until the gear sleeve 31 clears the splined sleeve 32. The roll mounting can then be rotated about shaft 12, to take the worn roll 24 out of the operative position and to bring, in its place, a new roll cartridge 25 from the other three fixed mounting positions.

57 and 58, each of which can turn about shaft 56, as well as moving axially on the shaft. The lower arm 58 rests on a platform 60, which surrounds the [illegible] which can be moved axially [illegible] cylinder [illegible]

a drive shaft supported by each of said eccentric shafts, each rotatable mounting having at least two fitments equally spaced from the axis of rotation of the mounting, each fitment being adapted to support a roll assembly, and coupling means for coupling each of the drive shafts with a roll assembly at its operative rolling position, whereby the rotation of the eccentric shafts adjusts the roll gap and rotation of each mounting brings the fitments in turn to a given position in which the roll assembly carried by that fitment is in the rolling position.

2. A rolling mill stand according to claim 1, and a plurality of roll assemblies, each of which comprises a work roll, bearings for the work rolls, and a carrier which supports the bearings and which is detachably securable to any fitment.

3. A rolling mill stand according to claim 2, in which the work roll is carried on, or forms part of a roll shaft which has at one end means engageable with the coupling means.

4. A rolling mill stand according to claim 3, in which the coupling means comprise, for each drive shaft, a gear sleeve to engage with gears on the respective drive shaft and on the respective roll shaft.

5. A rolling mill stand according to claim 2, in which the carrier of each roll assembly is wheel mounted, and which includes two sets of rails which can be entered into the stand housing to enable roll assemblies to be introduced to and removed from each of the mountings.

6. A rolling mill stand according to claim 5, in which the sets of rails form part of a roll change rig, which includes, for each mounting, a plurality of rail bays, and a railed roll carriage movable transversely of the bays to enable a roll assembly to be moved between the removable rails and any of the bays.

7. A rolling mill stand according to claim 1, in which each mounting is movable axially on its eccentric shaft to effect engagement and disengagement with the drive shaft.

8. A rolling mill stand according to claim 1, which includes a work guide arrangement comprising a pair of arms mounted independently on a rod for movement about the rod and axial movement along the rod, each arm being adapted to receive a guide and being movable between an effective position at the entry or the exit to the roll assemblies when in their operative rolling positions and an inoperative position remote from the roll assemblies.

* * * * *

UNITED STATES PATENT OFFICE

CERTIFICATE OF CORRECTION

Patent No. 4,136,545 Dated January 30, 1979

Inventor(s) Alexander I. Wilson

It is certified that error appears in the above-identified patent and that said Letters Patent are hereby corrected as shown below:

Column 1, lines 9 and 10, and column 2, lines 16 and 17, delete "the provisional specification of patent application No. 47037/75" and substitute therefor --U. S. Patent Application Serial No. 741,668--.

Column 4, line 11, delete "operative" and insert --inoperative--.

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*